US007910532B2

(12) United States Patent
Johnson et al.

(10) Patent No.: US 7,910,532 B2
(45) Date of Patent: Mar. 22, 2011

(54) HARD SURFACE CLEANER FORMULATION AND METHOD OF USE

(75) Inventors: Karin M. Johnson, Dana Point, CA (US); Tracy Palmer, Fallbrook, CA (US); William A Farone, Irvine, CA (US)

(73) Assignee: Karin M. Johnson, Dana Point, CA (US)

( * ) Notice: Subject to any disclaimer, the term of this patent is extended or adjusted under 35 U.S.C. 154(b) by 1071 days.

(21) Appl. No.: 11/398,824

(22) Filed: Apr. 6, 2006

(65) Prior Publication Data

US 2007/0238633 A1 Oct. 11, 2007

(51) Int. Cl.
*C11D 17/00* (2006.01)

(52) U.S. Cl. ..... 510/238; 510/240; 510/470; 510/481; 510/507

(58) Field of Classification Search ..... None
See application file for complete search history.

(56) References Cited

U.S. PATENT DOCUMENTS

| | | | | |
|---|---|---|---|---|
| 5,756,716 | A | 5/1998 | Farone et al. | |
| 6,423,677 | B1 | 7/2002 | Van Eenam | |
| 6,635,609 | B2 | 10/2003 | Sutton | |
| 6,723,692 | B2 | 4/2004 | Foley et al. | |
| 6,821,937 | B2 | 11/2004 | Gross | |
| 6,936,579 | B2 | 8/2005 | Urban | |
| 6,984,269 | B2 | 1/2006 | Motson | |
| 7,148,187 | B1 * | 12/2006 | Simon et al. | 510/235 |
| 2005/0043203 | A1 | 2/2005 | Barnabas et al. | |
| 2005/0043204 | A1 | 2/2005 | Barnabas et al. | |
| 2006/0052264 | A1 | 3/2006 | Lu | |
| 2007/0140984 | A1 * | 6/2007 | Kusano et al. | 424/49 |

FOREIGN PATENT DOCUMENTS

| | | | |
|---|---|---|---|
| JP | 2002143788 | A2 | 5/2002 |
| WO | WO 01/90287 | A1 | 11/2001 |

* cited by examiner

*Primary Examiner* — Necholus Ogden, Jr.
(74) *Attorney, Agent, or Firm* — Christie, Parker & Hale, LLP

(57) ABSTRACT

Formulations for producing a cleanser for cleaning hard surfaces and method of using.

28 Claims, No Drawings

HARD SURFACE CLEANER FORMULATION AND METHOD OF USE

FIELD OF THE INVENTION

The present invention is directed towards compositions of a hard surface cleaner and method of using. More specifically, the present invention is directed towards compositions and methods for improved cleaning and maintenance of hard surfaces with ease of use. In aspects of the invention environmentally friendly additives are used in a soap flake-water composition to increase the cleansing power of the composition.

Hard Surface Cleaning

Liquid compositions are presently used for cleaning and treating hard surfaces, such as marble, stone, granite, tiles, grout, pots, and other surfaces in the kitchen and bathrooms as well as in industry for similar hard surfaces which are present. These liquid compositions can be used in both the undiluted and diluted form. As is known to those skilled in the art, a liquid cleanser when used on a hard surface forms films and/or streaks on the surfaces. Thus after treatment, the formation of visible residues (streaks and/or films) can be observed. The addition of certain additives, such as antimicrobial agents, to the compositions have been also observed to increase the tendency to form films and streaks on the hard surface being treated. These films are known to reduce the shine that the surfaces normally exhibit.

There are cream/liquid products in the marketplace, such as Soft Scrub® or Comet®, which are claimed to be mild abrasive multipurpose bathroom and kitchen cleaner. These products come premixed and ready to use. One places the product on the surface to be cleaned and then rubs to remove dirt, grease, grime, and stains. However these products have the warning that to prevent scratching aluminum, fiberglass, appliance surfaces such as refrigerators, dishwashers, oven doors and other common household and industry appliances, one should use the product sparingly and rub gently with a damp sponge. There is no suggestion that this action will remove the grime and scum that is present. Other cream/liquid cleansers that suggest the absence of abrasives also indicate that 'extra scrubbing power' is required on hard surfaces to ensure cleaning.

The marketplace contains many powder cleansers for cleaning hard surfaces, such as Comet®, Bon Ami®, or Spic & Span® to name some commonly known products. For most surfaces it is recommended that one scrubs the surface to be cleaned, and for 'delicate' surfaces one is instructed to rub gently and rinse. These products also carry warnings regarding disposal and use of the cleaning composition. While the use of such materials, i.e. sodium dichloro-s-triazinetrione dihydrate, aids in disinfecting the surfaces, these materials by their very nature can be harmful both to the user and the environment. The concern for the environment has led to the removal and/or reduction of phosphates in many cleaning products that previously had been used for hard surface cleaning as well as laundry products.

In cleaning of hard surfaces, such as metals, ceramics, glass and plastics, the cleaning process, particularly in the domestic environment, may include mechanical action such as rubbing or scrubbing. In the institutional environment it is desirable to reduce mechanical rubbing or scrubbing.

In all types of cleaning, solvents are frequently used to improve soil removal by dissolving soil material, particularly oily, greasy or fatty solid, from the surface. Alkali materials can be included in the compositions, e.g. moderately strong alkali such as soda ash (sodium carbonate) as a buffer and/or builder, or strong alkali such as caustic soda (sodium hydroxide), which can improve the removal fatty, waxy, or oily soils particularly by hydrolysis of ester fats and oils. Surfactant, usually synthetic surfactant, materials are also commonly included to improve wetting of the substrate surface being cleaned. Compositions of this general type are known as cleaners and particularly as "hard surface cleaners".

Cleaning compositions are commercially important products and enjoy a wide field of utility in assisting in the removal of dirt and grime from surfaces which are also frequently encountered in lavatories, for example lavatory fixtures such as toilets, shower stalls, bathtubs, bidets, sinks, etc., as well as countertops, walls, floors, etc. In such lavatory environments there are various forms of undesirable residues including hard water stains as well as "soap scum stains". Hard water stains are mineral stains caused by the deposition of salts, such as calcium or magnesium salts, frequently present in hard water. Soap scum stains are residues of fatty acid soaps, such as soaps which are based on alkaline salts of low fatty acids. These fatty acids are known to precipitate in hard water due to the presence of metal salts therein leaving an undesirable residue upon such surfaces.

Various cleaning formulations have been produced, and it is generally known to the art which cleaning agents are generally suited for one type of stain but not necessarily for both classes of stains. For example, it is known to the art that cleaning agents comprising strong acids, such as hydrochloric acids, are useful in the removal of hard water stains. Other classes of cleaning compositions and formulations are known to be useful upon soap scum stains. These compositions typically comprise an organic and/or inorganic acid, one or more synthetic detergents and have limited use in other classes of stains.

General purpose household cleaning compositions for hard surfaces such as metal, glass, ceramic, plastic and linoleum surfaces are commercially available in both powdered and liquid form. Powdered cleaning compositions consist mainly of builder or buffering salts such as phosphates, carbonates, and silicates and although such compositions may display good inorganic soil removal, they exhibit inferior cleaning performance on organic soils such as greasy/fatty/oily soils.

Liquid cleaning compositions, on the other hand, have the great advantage that they can be applied to hard surfaces in neat or concentrated form so that a relatively high level of surfactant material is delivered directly to the soil. Moreover, it is a rather more straightforward task to incorporate high concentrations of anionic or nonionic surfactant in a liquid rather than a granular composition. For both of these reasons, therefore, liquid cleaning compositions have the potential to provide superior grease and oily soil removal over powdered cleaning compositions.

Nevertheless, liquid cleaning compositions also suffer a number of drawbacks. They generally contain little or no detergency salts and consequently they tend to have poor cleaning performance on particulate soil and are known to lack effectiveness under varying water hardness levels. Moreover, the higher in-use surfactant concentration necessary for improved grease soil removal causes further problems relating to extensive suds formation requiring frequent rinsing and wiping by the user.

Cooked-, baked- and burnt-on soils are among some of the most severe types of soils to remove from hard surfaces. Traditionally, the removal of cooked-, baked- and burnt-on soils from cookware and tableware requires soaking the soiled object prior to a scrubbing or mechanical action.

Manual dishwashing process requires a tremendous rubbing effort to remove cooked-, baked- and burnt-on soils and this can be detrimental to the safety and condition of the cookware/tableware.

The use of cleaning compositions containing solvent for helping in the removal of cooked-, baked- and burnt-on solids is known in the art For example, U.S. Pat. No. 5,102,573 provides a method for treating hard surfaces soiled with cooked-on, baked-on or dried-on food residues comprising applying a pre-spotting composition to the soiled article. The composition applied comprises surfactant, builder, amine and solvent. U.S. Pat. No. 5,929,007 provides an aqueous hard surface cleaning composition for removing hardened dried or baked-on grease soil deposits. The composition comprises nonionic surfactant, chelating agent, caustic, a glycol ether solvent system, organic amine and anti-redeposition agents. However, none of the art has been found to be very effective in removing baked-on, polymerized soil from metal and other substrates.

These cleaning compositions for use as hard surface cleansers are disclosed in U.S. patents/applications U.S. Nos. 20050043203, 2005043204, 20050106979, 20050148488, U.S. Pat. Nos. 6,423,677, 6,635,609, 6,984,269, 6,936,579, 6,821,937, and 6,723,692 which are all hereby incorporated by reference herein in their entirety.

Increasing Effectiveness of a Hard Surface Cleaning Agent

The present invention involves a novel solution for the problem presented above and is directed to a composition that gives effective cleaning of hard surfaces with little scrubbing on the part of the user. More particularly the invention relates to the incorporation of a sucrose ester into a soap flake-water mixture and methods of using the composition. Thus one of ordinary skill in the art, using the compositions of the present invention can avoid the problems associated with abrasive cleansers and with film forming cleansers.

Aspects of the present invention involve incorporating a sucrose ester, and a dry mixture into the soap flake-water mixture. The removal of the soil and the appearance of the hard surface were visually examined.

A typical formulation contains at least one sucrose ester, soap flakes, and a dry material such as celite or diatomaceous earth. The present invention discloses using additives which may comprise bleach or bleach alternatives to increase stain removal. Additional additives such as a scent formulation are also disclosed.

DEFINITIONS

The term, 'hard surface', refers to materials that are partially resistance to penetration by objects and usually do not absorb liquids readily that are found in both households and industry. Examples are marble; stone; granite; tiles; grout; pots, both ceramic and metallic; sinks, both porcelain and metal; porcelain; kitchen appliances including glass cook tops.

The term, 'cleaning tool', refers to any object used to clean a surface. The 'tool' directly contacts the surface to be cleaned. Cleaning tool objects include such conventional aids as sponges, cloths, paper or paper towels, absorbent pads, and disposable pads.

The term, 'cleaning implement', means any item used along with a cleaning tool to clean a surface. It can be used in conjunction with cleaning tools to effectively aid in making the cleaning task easier, more convenient, or more efficient. Implements can include mop heads or pole attachments.

The term, 'sucrose ester', refers to sucrose mono-esters, sucrose di-esters and mixtures thereof Examples of these sucrose esters may be found in U.S. Pat. No. 5,756,716.

All publications, including patents, published patent applications, scientific or trade publications and the like, cited in this specification are hereby incorporated herein in their entirety.

DETAILED DESCRIPTION

The present invention is drawn generally to compositions for use in methods to clean hard surfaces that result in clean surfaces without loss of shine and without leaving a gritty film or film streak.

Thus in one aspect the invention is drawn to a hard surface cleaning composition which contains a soap flake-water mixture and a sucrose ester. Such compounds may include $C_{16}$ to $C_{30}$ sucrose mono-esters of fatty acids, $C_{20}$ to $C_{48}$ sucrose di-esters of fatty acids, or mixtures. In certain aspects of this invention such compounds may include sucrose octanoate and sucrose laurate. Certain of the compounds of this aspect of the invention increase the ease of emulsifying the composition. Additionally the inclusion of the dry mixture tends to assist in the removal of stains without depositing a gritty film. The dry mixture comprises agents, for example, diatomaceous earth and celite.

In another aspect of the invention it has been found that by optionally including in the final mix a bleach or bleach alternative, one can increase the stain removal from hard surfaces. A non-limiting list of such compounds comprises sodium percarbonate, calcium peroxide, and magnesium peroxide.

A further aspect is the optional inclusion of a scent formulation in the mix to assist in concealing or removing malodors caused by breakdown of bacteria, molds, etc present in the soil on the hard surfaces. A non-limiting list of such compounds comprises lime, lemon, blood orange, lavender, pine and cedar.

In another aspect glycerin may be included in the formulation.

One example of a typical cleaning composition is as follows:

TABLE 1

| Chemical | Percent (w/w) |
|---|---|
| Soap flake Water Mix | 70% |
| Diatomaceous Earth | 25% |
| Sucrose Ester | 5% |

Another basic cleaning mixture formulation is as follows in Table 2:

TABLE 2

| Chemical | Percent (w/w) |
|---|---|
| Soap flake Water Mix | 45% |
| Diatomaceous Earth | 19% |
| Sucrose Ester | 1% |
| Glycerin | 35% |

In one aspect the concentration of the sucrose ester comprises between about 0.1% and about 20% (w/w) of the final mix. In another aspect the final formulation contains from about 0.5% and about 10% (w/w) of a sucrose ester. In a further aspect the final mix contains from about 5% and about 50% of the dry mixture. In another aspect the final mix formulation contains from about 10% and about 30% (w/w) of the dry mixture.

The embodiments and examples discussed and disclosed in the present application are illustrative only and do not exclude the use of other materials and/or other components, such as optional scent components. For example, addition of 0.1 parts of scent to the mixture results in a formulation in which the characteristics of the finished formulation have not changed.

EXAMPLES

The following Examples illustrate certain aspects and advantages of the present invention, which should be understood not to be limited thereby.

Example A

Formulation Preparation

For each batch the ingredients were added together and mixed. The soap flakes and water were mixed together and then the other ingredients were added. Small Then the batch is mixed using a system such as a progressive cavity pump.

Preparation of Two Formulations:

| Batch One | Batch Two |
|---|---|
| 70 g of Soap flake/Sucrose Octanoate Mix | 120 g of Soap flake/Sucrose Octanoate Mix |
| 130 g of Glycerin | 130 g of Glycerin |
| 250 g of Diatomaceous Earth/Baking Soda Mix | 250 g of Diatomaceous Earth/Baking Soda |
| 30 g of Additional Water | No extra water |
| Scents | Scents |

Example B

Tile Preparation

Tiles were prepared for testing the formulations.

Ceramic shiny green tiles were purchased from a local home hardware store. The tiles were 4×4 inches and were of the type that is commonly found in kitchen or bathroom counter tops. Five rows of six tiles each were set on a board. The tiles were cemented in position and normal tile grout was used between the tiles. After the tiles had set and the grout had dried, each row of tiles and the grout contained within the row was stained with one of the following compounds:

Soy sauce, ketchup, coffee, and red wine.

Example C

Tile Test Cleaning

The tiles for testing were prepared as in Example B. The stained tiles were cleaned using five different formulations as given below:

1. Sponge
2. Sponge with dish soap
3. Sponge with batch two
4. Sponge with batch one
5. Sponge with Dutch cleanser without bleach.

When cleaning the tiles, the circular strokes were counted and recorded.

TABLE 3

Number of Circular Strokes to Clean Tile

| | Sponge | Sponge w/Soap | Sponge w/Batch Two | Sponge w/Batch One | Sponge w/Dutch Cleanser |
|---|---|---|---|---|---|
| Soy Sauce | 32 | 18 | 6 | 5 | 3 |
| Ketchup | 21 | 13 | 4 | 3 | 3 |
| Coffee | 13 | 10 | 3 | 3 | 3 |
| Red Wine | 5 | 3 | 3 | 3 | 3 |

Example D

Test Tile and Grout Appearances

The tiles were prepared as in Example B and cleaned as in Example C. After cleaning the appearance of the tiles was recorded. The grout was also visually examined to ascertain as to stain removal.

TABLE 4

Tile Results

| | Sponge | Sponge w/Soap | Sponge w/Batch Two | Sponge w/Batch One | Sponge w/Dutch Cleanser |
|---|---|---|---|---|---|
| Soy Sauce | Streak Marks | Streak Marks & Rough to Touch | Shiny And Smooth | Shiny And Smooth | Shiny And Gritty |
| Ketchup | Streak Marks | Streak Marks & Rough to Touch | Shiny And Smooth | Shiny And Smooth | Shiny And Gritty |
| Coffee | Streak Marks | Streak Marks & Rough to Touch | Shiny And Smooth | Shiny And Smooth | Shiny And Gritty |
| Red Wine | Streak Marks | Streak Marks & Rough to Touch | Shiny And Smooth | Shiny And Smooth | Shiny And Gritty |

TABLE 5

Grout Results

| | Sponge | Sponge w/Soap | Sponge w/Batch Two | Sponge w/Batch One | Sponge w/Dutch Cleanser |
|---|---|---|---|---|---|
| Soy Sauce | Grout not Cleaned | Grout not Cleaned | Grout Cleaned | Grout Cleaned | Grout Cleaned |
| Ketchup | Grout not Cleaned | Grout not Cleaned | Grout Cleaned | Grout Cleaned | Grout Cleaned |
| Coffee | NA | NA | NA | NA | NA |
| Red Wine | Grout not Cleaned | Grout not Cleaned | Grout Cleaned | Grout Cleaned | Grout Cleaned |

Example E

Preparation of Formulation

For each batch the ingredients were added together as in Example A and were mixed.

TABLE 6

| Cleanser Formulations | | |
|---|---|---|
| | Batch A | Batch B |
| Soap Flakes | 8.59 grams | 14.72 grams |
| Sucrose Octanoate | 1.30 grams | 2.22 grams |
| Water | 90.11 grams | 103.06 grams |
| Baking Soda | 150 grams | 150 grams |
| Diatomaceous Earth | 100 grams | 100 grams |
| Glycerin | 130 grams | 130 grams |
| Scents | 20 drops | 20 drops |
| | ~1 gram | ~1 gram |

Example F

Tile Cleaning

The cleaning formulations were prepared as in Example E. Stained tiles (see Example B) are cleaned utilizing samples of formulations A and B. The stains were removed from the tiles by circular scrubbing with a damp sponge. The grout was also cleaned during the process. The results were similar to those given in Example D.

Example G

Preparation of 4 Cleaning Formulations

For each batch the ingredients are added together and are mixed.

TABLE

| Cleaning Formulations | | | | |
|---|---|---|---|---|
| | Batch C | Batch D | Batch E | Batch F |
| Soap Flakes | 9 grams | 15 grams | 10 grams | 12 grams |
| Sucrose Laurate | 1 grams | 3 grams | 2 grams | 1 grams |
| Water | 90 grams | 103 grams | 100 grams | 90 grams |
| Baking Soda | 150 grams | 125 grams | 100 grams | 135 grams |
| Diatomaceous Earth | 100 grams | 90 grams | 100 grams | 110 grams |
| Glycerin | 130 grams | NA | 130 grams | NA |
| Scents | 20 drops | NA | NA | 20 drops |
| | ~1 gram | | | ~1 gram |
| Bleach | | | 5 grams | 10 grams |

Example H

Tiles Cleaning

Cleaning formulations are prepared as given in Example G. Stained tiles (see Example B) are cleaned utilizing the four different formulations. The stains are removed from the tiles by circular scrubbing with a damp sponge. The grout is also cleaned during the process. The formulations containing the bleach are effective in stain removal from the tiles. The formulations without the glycerin are effective in stain removal from tiles. In both cases the grout is clean also after treatment with the formulations.

Example I

Porcelain Bathtub Cleaning

A bathtub previously stained with dark (brown black) hair dye was tested. The stain had been present on the floor of the bathtub for approximately 10 years. Commercially available cleansers were used without any visual removal of the stain. Batch One (Example A) was used to clean the stained area of the bathtub. A damp sponge containing the formulation was used with circular motions. After the cleaning, there was an approximately 75% reduction in visible stain.

Example J

Glass Cooktop Cleaning

A household glass cooktop used for normal and usual household cooking contained cooked on soil. Batch One (Example A) was used to remove the cooked on (baked on) soil. After cleaning the cooktop had no visible evidence of soil.

While this invention has been described with respect to various specific examples and embodiments, it is to be understood that the invention is not limited thereto and that it can be variously practiced with the scope of the following claims.

We claim:

1. A composition for cleaning hard surfaces comprising a soap-water mixture, a dry mixture, and a sucrose ester; wherein said hard surface is selected from one or more of the group consisting of marble, stone, granite, tiles, grout, pots, surfaces in a kitchen and surfaces in bathrooms.

2. The composition of claim 1 wherein the sucrose ester is selected from the group consisting of $C_{16}$ to $C_{30}$ sucrose mono esters of fatty acids, $C_{20}$ to $C_{48}$ sucrose di-esters of fatty acids and mixtures thereof.

3. The composition of claim 2 wherein the sucrose ester is selected from the group consisting of sucrose octanoate and sucrose laurate.

4. The composition of claim 1 comprising between about 0.1% to about 20% (w/w) of said sucrose ester.

5. The composition of claim 4 further comprising between about 0.5% to about 10% (w/w) of said sucrose ester.

6. The composition of claim 1 further comprises said dry mixture comprising an agent selected from the group consisting of diatomaceous earth, kieselguhr, silica, siliceous earth, diatomite, and celite.

7. The composition of claim 6 wherein said agent is diatomaceous earth.

8. The composition of claim 1 comprising between about 5% to about 50% (w/w) dry mixture.

9. The composition of claim 8 further comprising between about 10% to about 30% dry mixture.

10. The composition of claim 1 further comprising an additive selected from the group consisting of a bleach and a bleach alternative.

11. The composition of claim 10 wherein the additive is selected from the group consisting of sodium percarbonate, calcium peroxide, and magnesium peroxide.

12. The composition of claim 1 further comprising a scent formulation.

13. The composition of claim 12 wherein the scent formulation comprises one or more scent selected from the group consisting of lime, lemon, blood orange, lavender, pine, and cedar.

14. A cleanser formulation comprising a mixture of baking soda, diatomaceous earth, glycerin, and soap-water mixture.

15. The formulation of claim 14 further comprising sucrose ester, wherein the sucrose ester is selected from the group consisting of $C_{16}$ to $C_{30}$ sucrose mono esters of fatty acids, $C_{20}$ to $C_{48}$ sucrose di-esters of fatty acids and mixtures thereof.

16. The formulation of claim 15 wherein the sucrose ester is selected from the group consisting of sucrose octanoate and sucrose laurate.

17. The formulation of claim 15 comprising between about 0.1% to about 20% (w/w) of said sucrose ester.

18. The formulation of claim 17 further comprising between about 0.5% to about 10% (w/w) of said sucrose ester.

19. The formulation of claim 14 further comprising dry mixture, wherein said dry mixture comprises an agent selected from the group consisting of kieselguhr, silica, siliceous earth, diatomite, and celite.

20. The formulation of claim 19 wherein said agent is siliceous earth.

21. The formulation of claim 14 comprising between about 5% to about 50% (w/w) diatomaceous earth.

22. The formulation of claim 21 further comprising between about 10% to about 30% (w/w) diatomaceous earth.

23. The formulation of claim 14 comprising between about 1% to about 20% (w/w) glycerin.

24. The formulation of claim 23 further comprising between about 5% to about 10% (w/w) glycerin.

25. The formulation of claim 14 further comprising an additive.

26. The formulation of claim 25 wherein the additive is selected from the group consisting of bleach, sodium percarbonate, calcium peroxide, and magnesium peroxide.

27. The formulation of claim 14 further comprising a scent formulation.

28. The formulation of claim 27 wherein scent formulation comprises one or more scent selected from the group consisting of lime, lemon, blood orange, lavender, pine and cedar.

* * * * *